US012446642B2

(12) United States Patent
Berman

(10) Patent No.: US 12,446,642 B2
(45) Date of Patent: Oct. 21, 2025

(54) SYMMETRIC GARMENT BELT

(71) Applicant: Reuben Berman, Ashkelon (IL)

(72) Inventor: Reuben Berman, Ashkelon (IL)

( * ) Notice: Subject to any disclaimer, the term of this patent is extended or adjusted under 35 U.S.C. 154(b) by 408 days.

(21) Appl. No.: 17/934,210

(22) Filed: Sep. 22, 2022

(65) Prior Publication Data

US 2023/0119222 A1 Apr. 20, 2023

(51) Int. Cl.
*A41F 9/00* (2006.01)

(52) U.S. Cl.
CPC ..... *A41F 9/002* (2013.01)

(58) Field of Classification Search
CPC ..... A41F 9/00; A41F 9/02; A41F 1/02; A41F 1/007; A41F 1/002
See application file for complete search history.

(56) References Cited

U.S. PATENT DOCUMENTS 5,127,136 A * 7/1992 Magnus ..... A44B 11/226 24/177
5,871,129 A * 2/1999 Boncompagni ..... A44B 11/005 224/163
8,302,266 B2 * 11/2012 Chen ..... A44B 11/001 2/322
9,307,808 B1 * 4/2016 Lill ..... A44B 99/00
9,351,526 B1 * 5/2016 Taylor ..... A44B 11/125
9,770,073 B2 * 9/2017 Ryou ..... A44B 11/16
10,791,714 B2 * 10/2020 Waters ..... A44C 15/00
11,019,887 B1 * 6/2021 Huang ..... A44B 11/06
11,857,032 B1 * 1/2024 Rowland ..... A44B 11/006
2007/0193004 A1 * 8/2007 Chou ..... A44B 11/06 24/170
2016/0206051 A1 * 7/2016 Minson ..... A44B 11/04
2017/0150787 A1 * 6/2017 Custer ..... A44B 11/04
2017/0290302 A1 * 10/2017 Waters ..... A44B 11/125
2019/0281930 A1 * 9/2019 Taylor ..... A44B 11/22
2021/0015216 A1 * 1/2021 Kim ..... A41F 9/025
2021/0235820 A1 * 8/2021 Thompson ..... A44B 11/065
2021/0315300 A1 * 10/2021 Briggs ..... A41F 9/002
2023/0019888 A1 * 1/2023 Barr ..... A41F 9/002
2023/0119222 A1 * 4/2023 Berman ..... A41F 9/002 2/338

FOREIGN PATENT DOCUMENTS

WO 2010/087998 8/2010

* cited by examiner

*Primary Examiner* — Richale L Quinn

(57) ABSTRACT

The present invention is directed to a belt device (200), comprising: a strap (11); a buckle (10) comprising a front panel (10*a*) and a back panel (10*b*); a fastener, for preventing from the strap to loosen; a first (21) and a second (22) entrances, for entry of opposite edges of the strap (11) into the buckle (10); an exit (23) for a trail (13) to an inner side of the belt device; a curved passage (20) connecting one of the entrances with the exit (23), thereby when wearing the belt device, concealing the trail (13), and providing a symmetry to the belt device.

10 Claims, 10 Drawing Sheets

SYMMETRIC GARMENT BELT

TECHNICAL FIELD

The present invention relates to the field of garment belts.

BACKGROUND ART

The term "symmetry" of a garment belt hereby refers to a belt which as viewed in the eyes of a bystander, its left side is identical to its right side. In such garment belts the trail is directed hidden or does not exist.

Some people place an emphasis on appearance, and the symmetry of their belt is important to them.

The term "belt" refers herein to a garment belt.

Each of FIGS. 1*a*, 1*b* and 1*c* schematically illustrates a belt device 100, according to the prior art. FIG. 1*a* is a front view, FIG. 1*b* is a perspective view, and FIG. 1*c* is a sectioned top view.

This belt device is published at the following web address: https://www.youtube.com/watch?v=3k2q7QcSzpw, by MIN BELT. In the video clip it starts from 04:25 minute.

As shown in the figures, although in a front view the belt device looks symmetric and has no holes that defect this look, as can be seen from the top view of FIG. 1*c* the belt device is not symmetric. Reference numeral 24 points on the asymmetric region.

All the prior-art belts have not yet provided satisfactory solutions to the problem of symmetry of a belt device.

It is an object of the present invention to provide a solution to the above-mentioned and other problems of the prior art.

Other objects and advantages of the invention will become apparent as the description proceeds.

SUMMARY OF THE INVENTION

The present invention is directed to a belt device (200), comprising:

- a strap (11);
- a buckle (10) comprising a front panel (10*a*) and a back panel (10*b*);
- a fastener, for preventing from the strap to loosen;
- a first (21) and a second (22) entrances, for entry of opposite edges of the strap (11) into the buckle (10);
- an exit (23) for a trail (13) to an inner side of the belt device;
- a curved passage (20) connecting one of the entrances with the exit (23),
- thereby when wearing the belt device, concealing the trail (13), and providing a symmetry to the belt device.

Preferably, the strap (11) is firmly connected to the front panel.

Preferably, the front panel comprising side walls (14). However, alternatively the back panel comprises side walls (14).

Preferably, the fastener locks a position of the front panel with reference to the back panel.

According to one embodiment of the invention, the fastener comprises a bulge (26) for fastening the back panel to the strap when the device is locked.

According to one embodiment of the invention, the fastener is in a form of grooves (25) at an inner side of the strap, and a bulge (26) on the back panel (10*b*), correspondingly with the grooves.

According to another embodiment of the invention, the fastener is in a form of:

- rails allowing shifting the panels one with reference to the other;
- a fixture, for fixing a position of the panels with reference to each other,
- thereby allowing fixing the panels one with reference to the other such that the curved passage fastens the strap.

The fixture may be in a form of a bolt entering from one panel of the buckle, to another panel of the buckle.

According to one embodiment of the invention, the rails are disposed in the sidewalls of one of the panels, and corresponding grooves are disposed on the other panel.

According to one embodiment of the invention, the rails

According to one embodiment of the invention, the fastener is in a form of a snap connector.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF DRAWINGS

Preferred embodiments, features, aspects and advantages of the present invention are described herein in conjunction with the following drawings.

Each of FIGS. 1*a*, 1*b* and 1*c* schematically illustrates a belt device 100, according to the prior art.

Figure 8A:
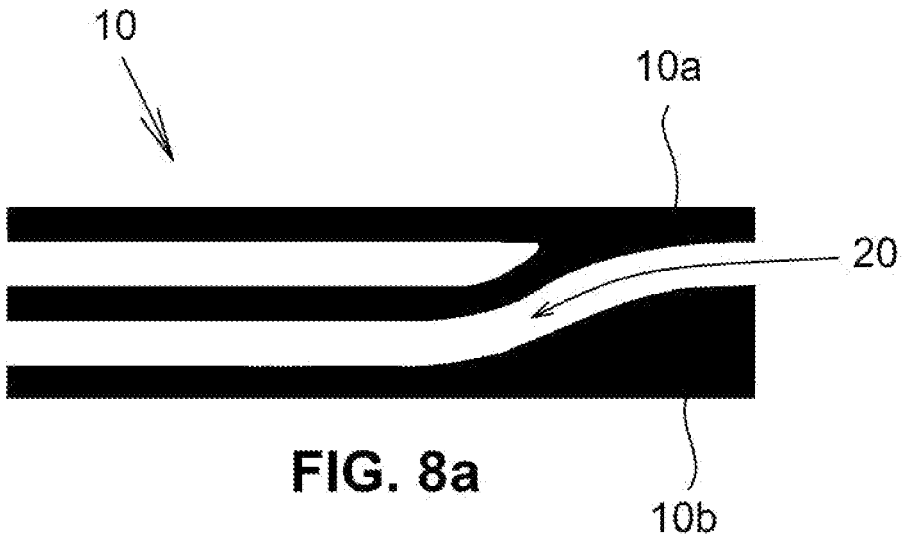
Figure 8B:
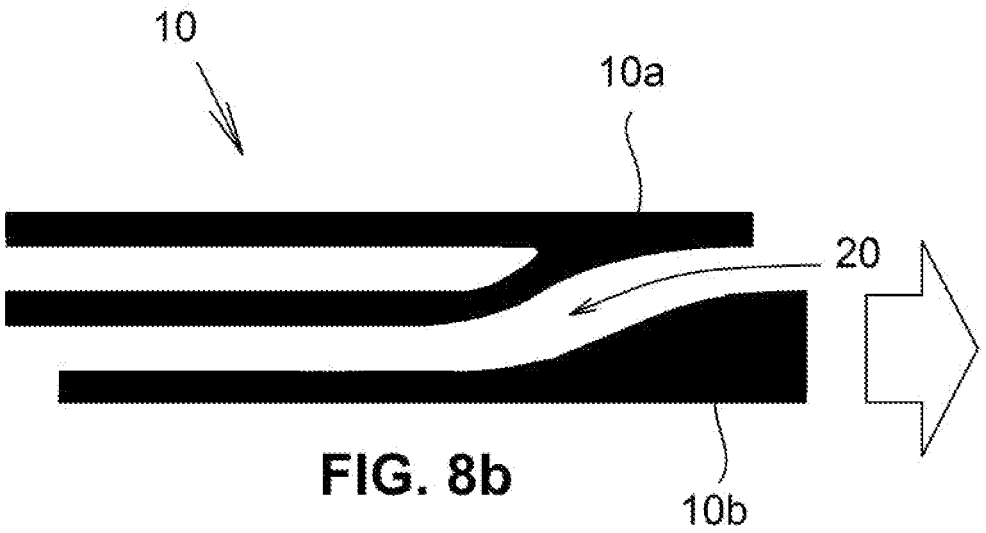
Figure 8C:
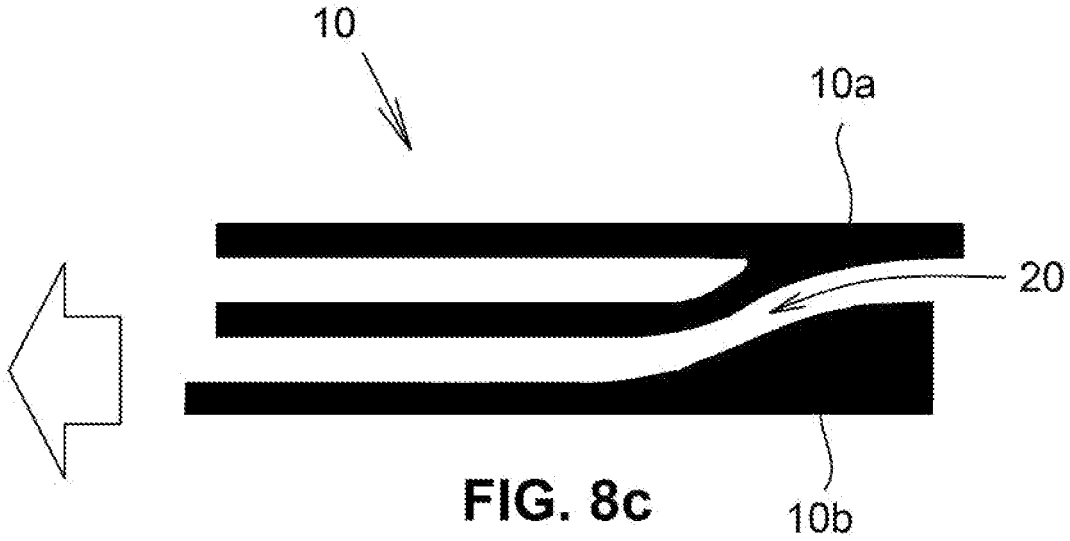

Each of FIGS. 8*a*, 8*b* and 8*c* is a cross-section schematically illustrating a buckle 10, according to one embodiment of the invention.

Figure 9A:
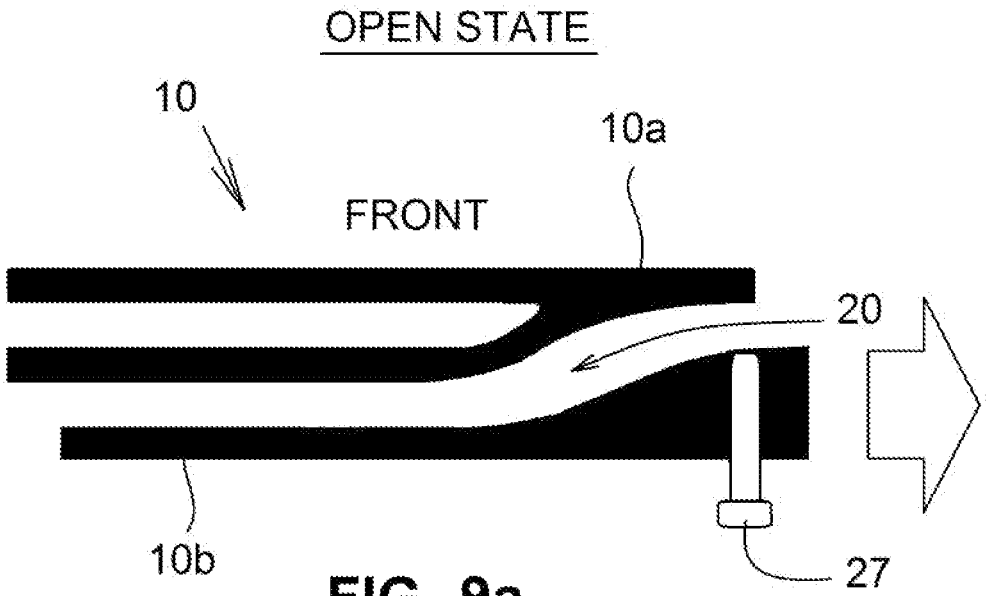
Figure 9B:
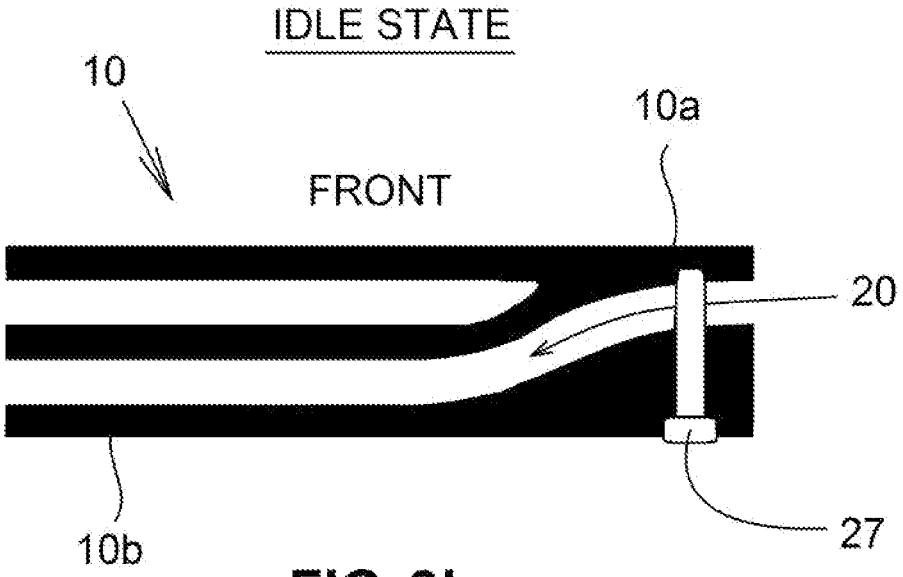

Each of FIGS. 9*a* and 9*b* is a cross-section schematically illustrating a buckle 10, according to one embodiment of the invention.

Figure 10A:
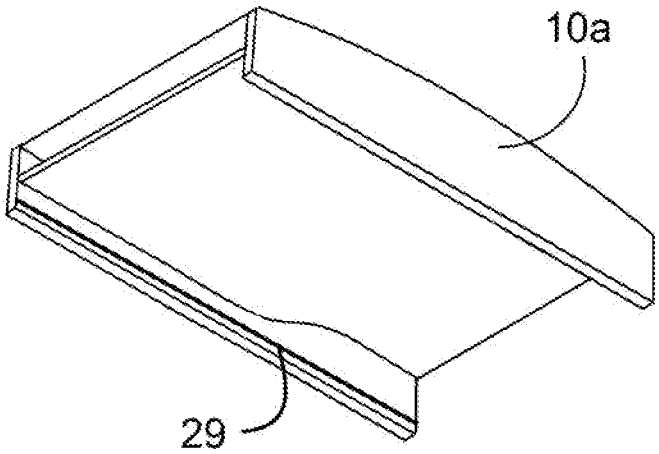

FIG. 10*a* schematically illustrates a front panel 10*a* from a bottom-perspective view, according to one embodiment of the invention.

Figure 10B:
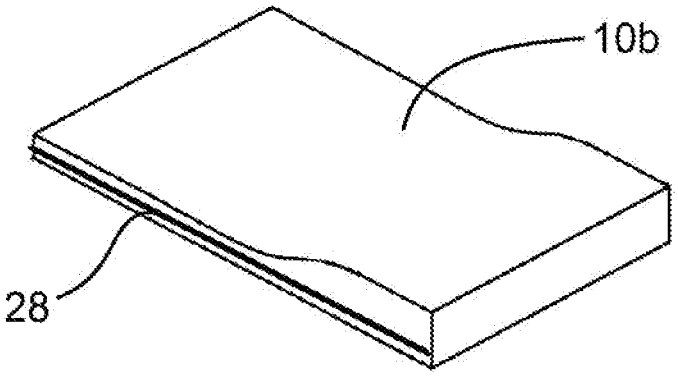

FIG. 10*b* schematically illustrates a back panel 10*b* from top-perspective view, according to one embodiment of the invention.

It should be understood that the drawings are not necessarily drawn to scale.

DESCRIPTION OF EMBODIMENTS

The present invention will be understood from the following detailed description of preferred embodiments ("best mode"), which are meant to be descriptive and not limiting. For the sake of brevity, some well-known features, methods, systems, procedures, components, circuits, and so on, are not described in detail.

The term "front" or "outer" of a belt hereby refers to the side seen by a bystander when the belt is being worn by a user. The term "back" or "inner" of a belt hereby refers to the side hidden from a bystander when the belt is being worn by a user.

Figure 2A:
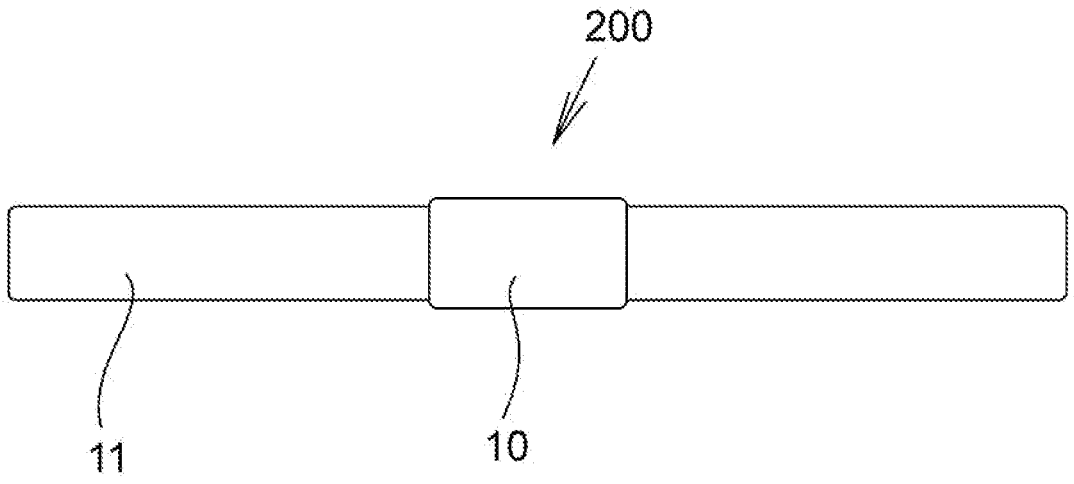
FIG. 2*a* is a front view of a belt 200, according to one embodiment of the invention.

FIG. 2*a* is a front view of a belt 200, according to one embodiment of the invention.

As illustrated the trail is concealed, and no holes are seen. These features result with symmetric look to the belt 200 when being worn by a user.

Figure 2B:
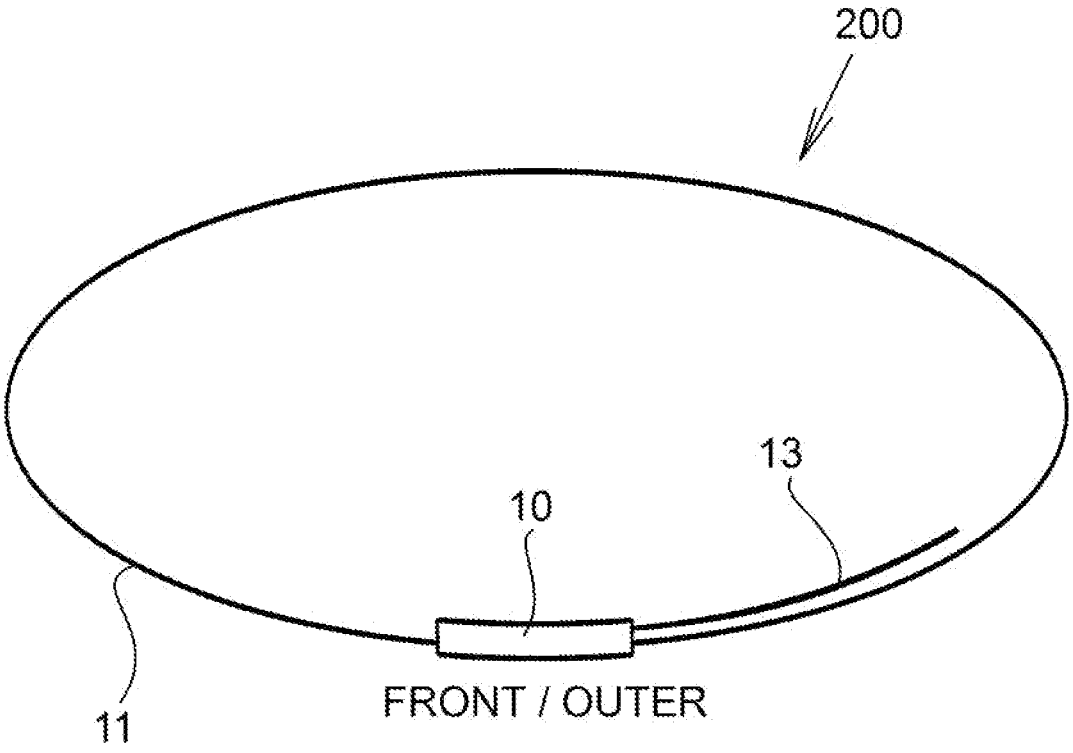
FIG. 2*b* is a top view of a belt device 200, according to one embodiment of the invention.

FIG. 2*b* is a top view of a belt device 200, according to one embodiment of the invention.

As shown, the belt trail 13 is placed in the inner side of a worn belt, thereby concealing the trail when wearing the belt, which provides to the belt a symmetric look.

Figure 3A:
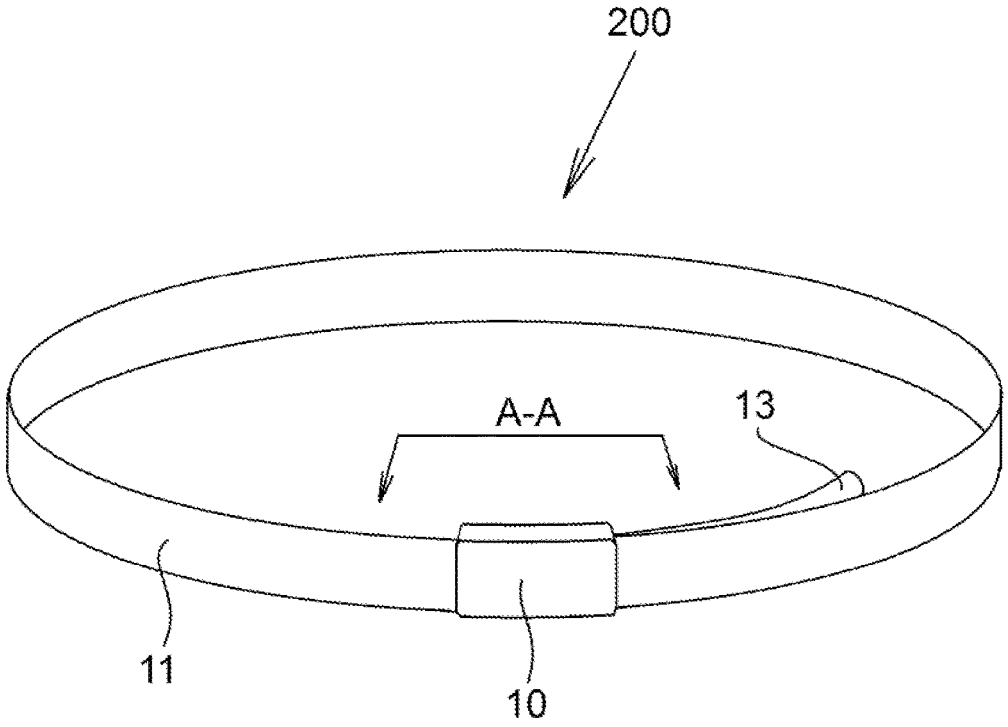
FIG. 3*a* is a perspective view of a belt device 200, according to one embodiment of the invention.

FIG. 3*a* is a perspective view of a belt device 200, according to one embodiment of the invention.

As shown, the belt trail 13 is placed in the inner side of a worn belt, thereby concealing the trail from a person that does not wear it. This provides to the belt a symmetric look when being worn.

The figure also defines a cross-section A-A.

Figure 3B:
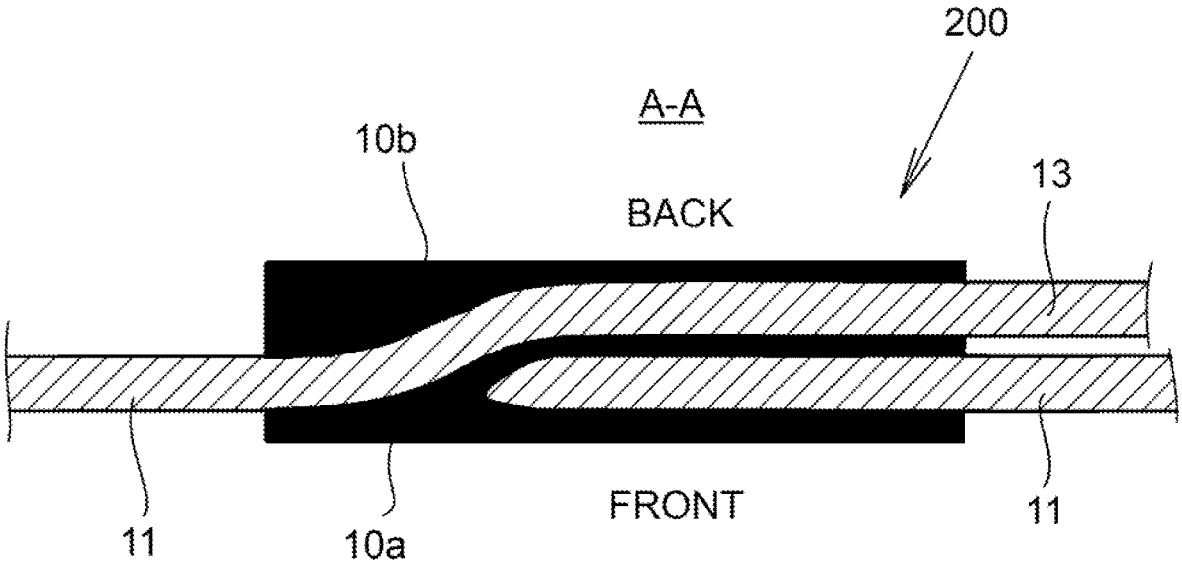
FIG. 3*b* is across-section of a belt device 200, according to one embodiment of the invention.

FIG. 3*b* is across-section of a belt device 200, according to one embodiment of the invention.

Figure 4:
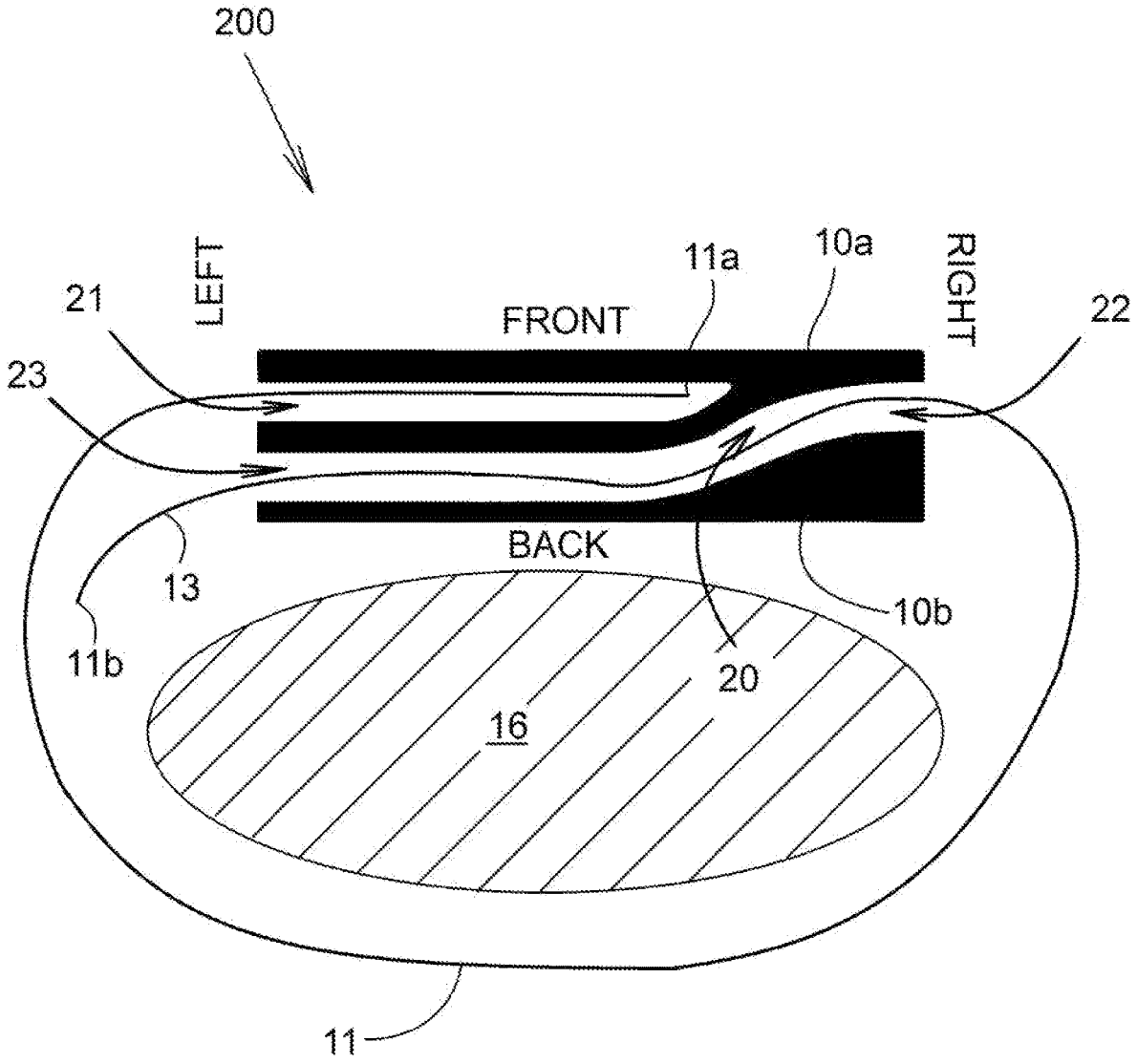
FIG. 4 is a schematic across-section of a belt device 200, according to one embodiment of the invention.

The cross-section is defined in FIG. 4 as A-A.

In the figures herein the captions FRONT and BACK refer to the front of the buckle and the back of the buckle.

The buckle comprises a front panel 10*a* and a back panel 10*b*, connected to each other such that a gap between them allows passing a strap therebetween.

The first edge of the strap 11 of the belt device 200 is fixed into panel 10*a* of the buckle. The length of the strap is set by shifting the belt in the gap between panel 10*a* and panel 10*b* of the buckle. The second end, i.e., the trail 13, is the other end of the strap which outstands from the buckle.

FIG. 4 is a schematic across-section of a belt device 200, according to one embodiment of the invention.

The figure illustrates the way a strap 11 is threaded into the buckle. It should be noted that the drawing is not drawn to the scale.

As mentioned, the buckle comprises a front panel 10*a* connected to a back panel 10*b*.

One edge of the strap, 11*a*, is firmly connected to the front panel 10*a*. The strap 11 enters into the buckle 10 through entrance 21, which is disposed of the left side (in the figure orientation) at the front side of the buckle. The strap continuation surrounds the user 16, and then enters into entrance 22 at the right side of the buckle at the front side thereof. In continues in a curved passage 20 (which is generated in a gap between the front panel 10*a* and the back panel 10*b*). The end of the strap 11, which is marked as 11*b*, exits from the buckle to the inner side of the belt device when being worn. The part of the belt that exits from the buckle to its end 11*b* is its trail, and is marked herein by reference numeral 13.

Figure 1A:
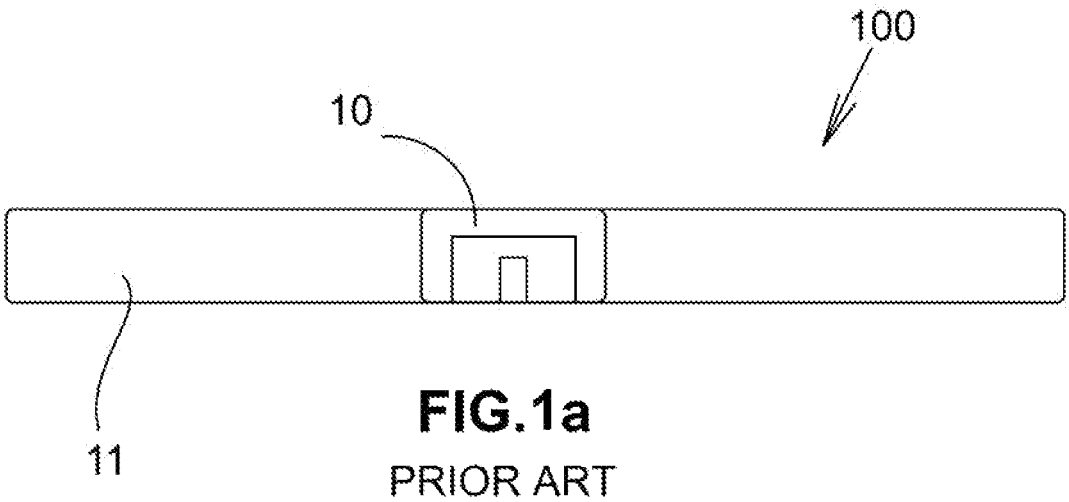
FIG.1a PRIOR ART
FIG. 1*a* is a front view.
Figure 1B:
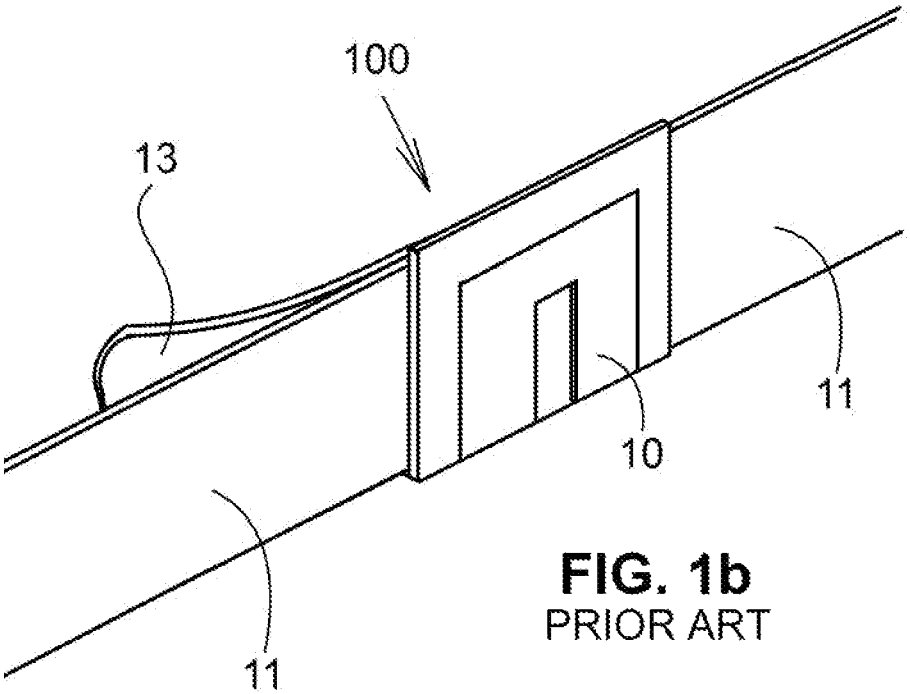
FIG. 1b PRIOR ART
FIG. 1*b* is a perspective view.
Figure 1C:
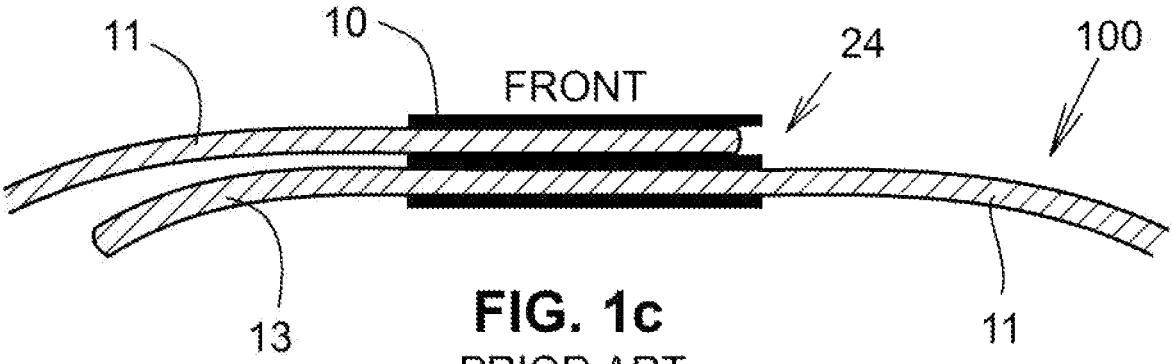
FIG. 1c PRIOR ART
FIG. 1*c* is a sectioned top view.

As can be seen, both entrances 21 and 22 are at the front side of the belt device. In this way, the belt device not only conceals the trail 13 when the belt device is being worn, but the strap is disposed at the front side of the buckle in both sides which provides a symmetric look. This is in contrast to the prior art embodiment of FIGS. 1*a*, 1*b* and 1*c* which does not provide such a symmetry.

The mechanical feature that allows achieving this symmetry is the curved passage 20. As shown, the curved passage 20 directs the strap 11 that enters into the buckle from entrance 22 which is at the front side of the buckle, to exit from exit 23, which is at the inner (back) side of the belt device when being worn by a user.

Figure 5:
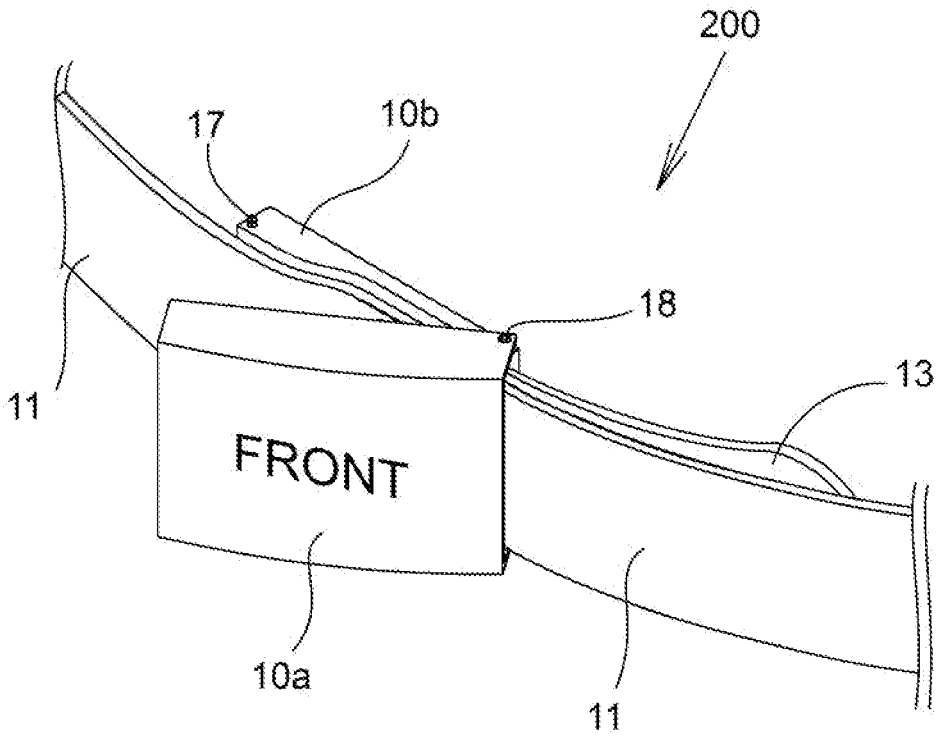
FIG. 5 is perspective view of a belt device 200, according to one embodiment of the invention.

FIG. 5 is perspective view of a belt device 200, according to one embodiment of the invention.

As shown, the trail 13 is disposed at the inner side of the belt device (when worn by a user), thereby the trail is concealed when the belt device is being worn by a user.

The caption FRONT on the buckle 10 is not a part of the belt device, but rather denotes that this is the front side of the buckle.

The figure illustrates a locking mechanism, according to one embodiment of the invention. The inner panel 10*b* is rotatable along hinge 18.

The mechanism that holds panel 10*b* in its position when the buckle is close is pin 17 of panel 10*b* and a corresponding depression of panel 10*a* (not shown in this figure). Actually, it is a snap connector.

Figure 6:
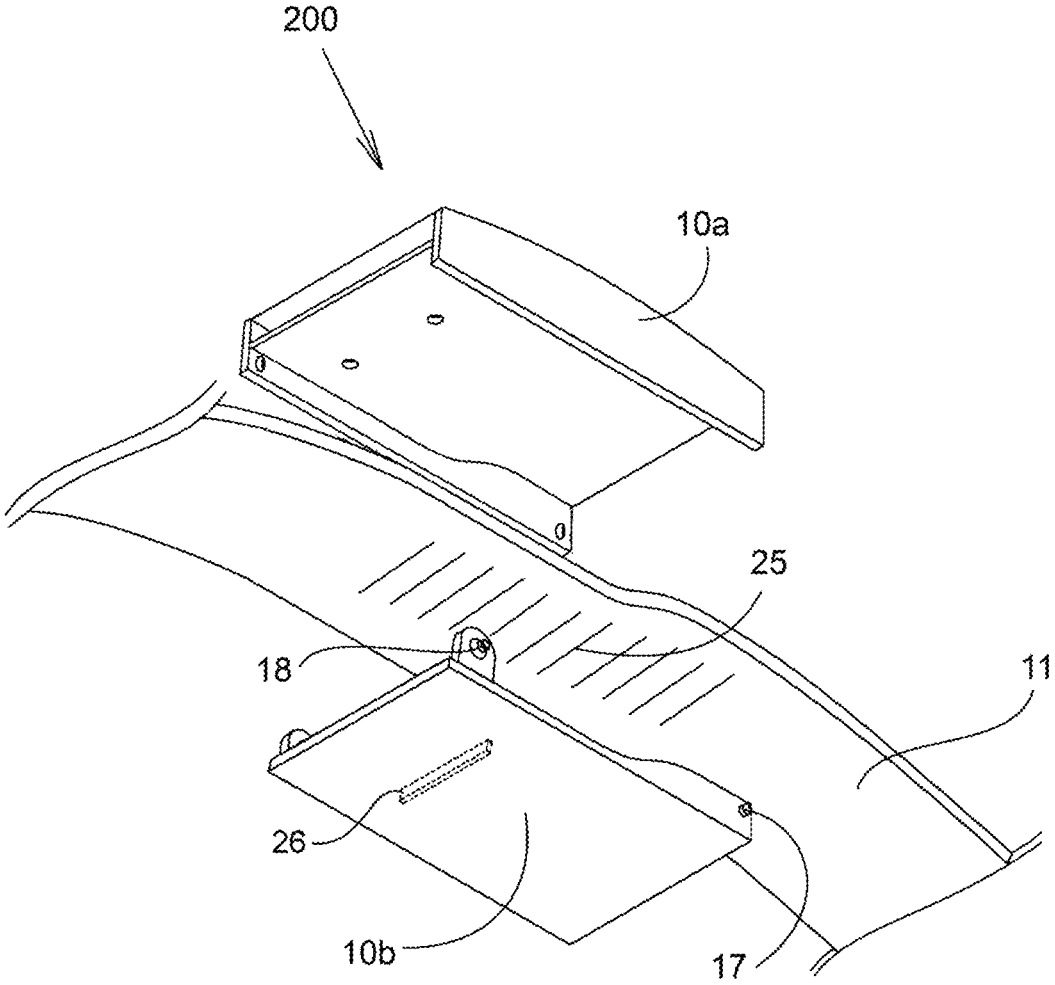
FIG. 6 is a bottom-exploded view of a belt device 200, according to one embodiment of the invention.

FIG. 6 is a bottom-exploded view of a belt device 200, according to one embodiment of the invention.

As shown, the strap 11 of the belt comprises grooves 25.

Figure 7:
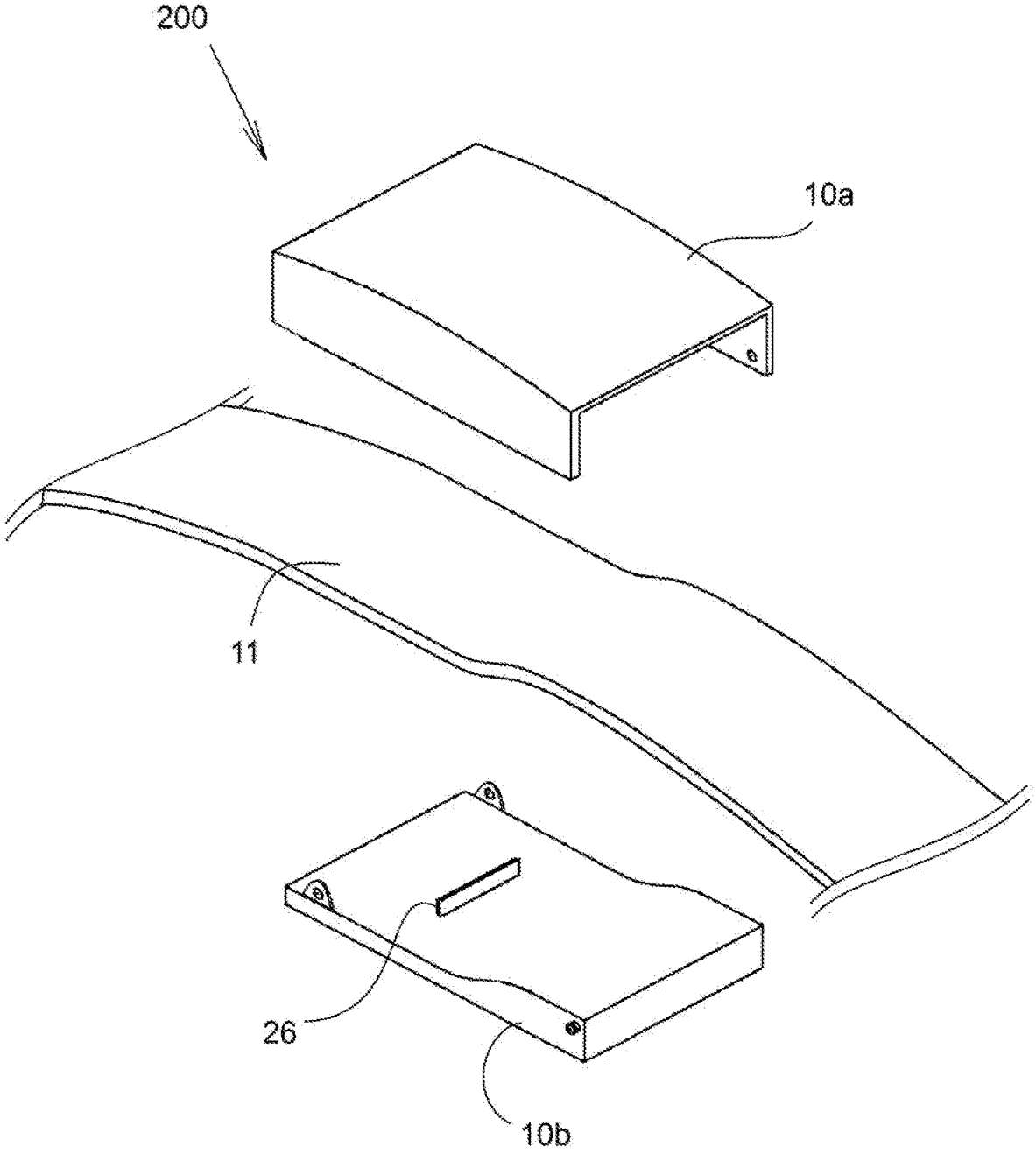
FIG. 7 is a top-exploded view of a belt device 200, according to one embodiment of the invention.

FIG. 7 is a top-exploded view of a belt device 200, according to one embodiment of the invention.

The inner side of panel 10*b* comprises a bulge 26. When the belt device 200 is in its close state, i.e., panel 10*b* is fastened against panel 10*a* of the buckle, bulge 26 mates with its closest groove 25, thereby keeping the strap 11 in the current position, i.e., preventing from the strap to loosen.

Actually, the bulge 26 is adequate, since an appropriate design can use only the force of the bulge on the strap.

In addition, when no grooves are implemented, using a plurality of bulge is preferable in order to increase the fastening force.

Each of FIGS. 8*a*, 8*b* and 8*c* is a cross-section schematically illustrating a buckle 10, according to one embodiment of the invention.

According to this embodiment of the invention, the panels 10*a* and 10*b* of the buckle can be moved one relative to the other. Since passage 20 between the panels is curved, at the curved region of passage 20 the width of the passage depends on the position of the panels one relative to the other. When panel 10*b* is shifted to the right as illustrated in FIG. 8*b*, the width of the curved region is larger than in FIG. 8*a*. When panel 10*b* is shifted to the left as illustrated in FIG. 8*c*, the passage width is smaller than in FIG. 8*a*.

As such, a buckle designed such that the width of the curved passage in the idle state is smaller than the width of the passage when shifted in one direction secures the strap in its idle state, i.e., the shifting ability along with the width of the passage is used as a fastener.

Each of FIGS. 9*a* and 9*b* is a cross-section schematically illustrating a buckle 10, according to one embodiment of the invention.

FIG. 9*a* illustrates an open state, i.e., a situation wherein the panels 10*a* and 10*b* are shifted with reference to each other such that the curved region of the passage 20 between them allows threading therebetween a strap (not shown).

FIG. 9*b* illustrates an idle state, i.e., a situation wherein a user wears the belt apparatus. In this situation the curved region of the panels secures the strap therebetween (not shown).

Reference numeral 27 denotes a bolt, used as a fixture, entering from one panel of the buckle, to the other panel of the buckle, thereby fixing the panels of the buckle with reference to each other.

FIG. 10*a* schematically illustrates a front panel 10*a* from a bottom-perspective view, according to one embodiment of the invention.

This figure shows a groove 29 at the inner side of the sidewall of the front panel 10*a*.

FIG. 10*b* schematically illustrates a back panel 10*b* from top-perspective view, according to one embodiment of the invention.

This figure shows a rail 28 at the back panel 10*b*, correspondingly with groove 29 of the front panel 10. The groove is shown at FIG. 10*a*.

Referring to MIN BELT, while in the present invention the passage 20 is curved, in MIN BELT the passage is straight. As a result, according to the present invention the distance between the front panel and the edges of the belt strap 11 at the entry/exit of the buckle are equal in both sides, while in MIN BELT they differ, which defects the symmetric look of the belt.

In the figures and/or description herein, the following reference numerals (Reference Signs List) have been mentioned:

Numeral 100 denotes a belt, according to the prior art;
numeral 200 denotes a belt, according to one embodiment of the invention;
numeral 10 denotes a buckle;
numeral 10*a* denotes a front panel of buckle 10;
numeral 10*b* denotes a back panel of buckle 10;
numeral 11 denotes a strap of a belt;
numeral 11*a* denotes one edge of strap 11;
numeral 11*b* denotes another edge of strap 11;
numeral 13 denotes a trail of a belt;
numeral 14 denotes a side wall of a buckle;
numeral 16 denotes a user;
numeral 17 denotes a pin;
numeral 18 denotes a hinge;
numeral 20 denotes a curved passage;
numeral 21 denotes a first strap entrance into the buckle, at the front panel side;
numeral 22 denotes a second entrance into the buckle, at the front panel side;
numeral 23 denotes a strap exit from the buckle, at the back panel side, at the back panel side (for the trail);
numeral 24 denotes an asymmetric part of a belt device;
numeral 25 denotes a groove;
numeral 26 denotes a bulge, corresponding to groove 25;
numeral 27 denotes a bolt, used as a fixture for fixation of the position of the panels with reference to each other;
numeral 28 denotes a rail.
numeral 29 denotes a groove correspondingly to rail 28; and In the description herein, the following references have been mentioned: MIN BELT https://www.youtube.com/watch?v=3k2q7QcSZpw The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

The invention claimed is:

1. A belt device (200), comprising:
a strap (11);
a buckle (10) comprising a front panel (10*a*) and a back panel (10*b*);
a fastener, for preventing from said strap to loosen;
a first (21) and a second (22) entrances, for entry of opposite edges of said strap (11) into said buckle (10);
an exit (23) for a trail (13) to an inner side of said belt device;
a curved passage (20) connecting one of the entrances with said exit (23),
wherein said fastener locks a position of said front panel with reference to said back panel,
thereby when wearing said belt device, concealing said trail (13), and providing a symmetry to said belt device.

2. The belt device according to claim 1, wherein said strap (11) being firmly connected to said front panel.

3. The belt device according to claim 1, wherein said front panel comprising side walls (14).

4. The belt device according to claim 1, wherein said back panel comprising side walls (14).

5. The belt device according to claim 1, wherein said fastener comprises a bulge (26) for fastening said back panel to said strap when said device is locked.

6. The belt device according to claim 1, wherein said fastener comprises grooves (25) at an inner side of said strap, and said back panel (10*b*) comprises a bulge (26) correspondingly with said groves.

7. The belt device according to claim 1, wherein said fastener comprising:
rails (28) allowing shifting the front panel and the back panel one with reference to the other;
a fixture, for fixing a position of the front panel and the back panel with reference to each other,
thereby allowing fixing the front panel and the back panel one with reference to the other such that said curved passage fastens said strap.

8. The belt device according to claim 7, wherein said fixture is in a form of a bolt entering from one panel of said buckle, to another panel of said buckle.

9. The belt device according to claim 7, wherein said rails are disposed in sidewalls of one of the panels, and corresponding grooves are disposed on other panel.

10. The belt device according to claim 1, wherein said fastener is a snap connector.

* * * * *